US005450685A

United States Patent [19]

Peterson

[11] Patent Number: 5,450,685

[45] Date of Patent: Sep. 19, 1995

[54] FIREARM SECURITY DEVICE

[76] Inventor: Bruce A. Peterson, 7743 Tuscarora Ave., El Paso, Tex. 79912-1104

[21] Appl. No.: 383,072

[22] Filed: Feb. 3, 1995

[51] Int. Cl.[6] ..... F41C 27/00

[52] U.S. Cl. ..... 42/70.11

[58] Field of Search ..... 42/70.11, 66, 70.01, 42/96; 89/30, 31

[56] References Cited

U.S. PATENT DOCUMENTS

| | | | |
|---|---|---|---|
| 2,478,098 | 8/1949 | Hansen . | |
| 2,530,560 | 11/1950 | Young . | |
| 2,803,909 | 8/1957 | Soski et al. . | |
| 2,836,918 | 6/1958 | Pula et al. . | |
| 2,923,323 | 2/1960 | Franck . | |
| 2,937,666 | 5/1960 | Maisch . | |
| 3,768,189 | 10/1973 | Goodrich | 42/70.11 |
| 4,023,294 | 5/1977 | Knopp . | |
| 4,224,753 | 9/1980 | Bielman . | |
| 4,479,320 | 10/1984 | Fix | 42/70.11 |
| 4,512,099 | 4/1985 | Mathew . | |
| 4,908,971 | 3/1990 | Chaney . | |
| 5,010,674 | 4/1991 | Horton . | |
| 5,048,211 | 9/1991 | Hepp . | |
| 5,115,589 | 5/1992 | Shuker . | |
| 5,138,785 | 8/1992 | Paterson . | |
| 5,171,924 | 12/1992 | Honey et al. . | |
| 5,179,234 | 1/1993 | Cvetanocich . | |
| 5,239,767 | 8/1993 | Briley, Jr. et al. . | |
| 5,241,770 | 9/1993 | Lambert . | |
| 5,289,653 | 3/1994 | Szebeni et al. . | |
| 5,315,778 | 5/1994 | Wolford . | |

FOREIGN PATENT DOCUMENTS 2561369 3/1984 France .

*Primary Examiner*—Charles T. Jordan
*Assistant Examiner*—Christopher K. Montgomery
*Attorney, Agent, or Firm*—Robert W. Harris

[57] ABSTRACT

A firearm security device, to temporarily disable a firearm. The principal components of the device are an anchor, formed of material which may be stretched, which is slightly oversized in relation to the gun barrel bore and chamber diameter; and an extractor, which may be screwed onto one end of the anchor, and is used both for inserting and removing the anchor from the gun barrel and chamber. The extractor also has an actuating rod passing therethrough, which is used to exert stretching force on a shaft passing through the anchor and secured to the opposite end of the anchor, for stretching the anchor longitudinally so as to reduce its diameter sufficiently to allow insertion of the anchor into the firearm barrel and chamber. After the anchor is inserted, with the stretching force applied, the user ceases applying the stretching force, so that the anchor becomes wedged within the barrel and chamber, as it seeks to return to its normal diameter. The extractor is then removed, to leave the firearm in a disarmed state. To arm the weapon, the extractor is again inserted and screwed onto the anchor, and the above-described steps are carried out in reverse order, to remove the anchor and extractor from the barrel and chamber of the weapon.

10 Claims, 2 Drawing Sheets

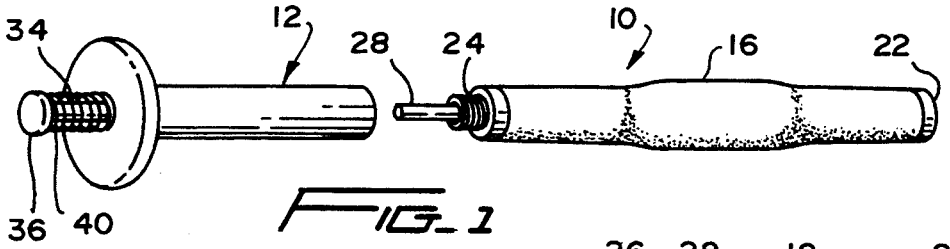
FIG. 1
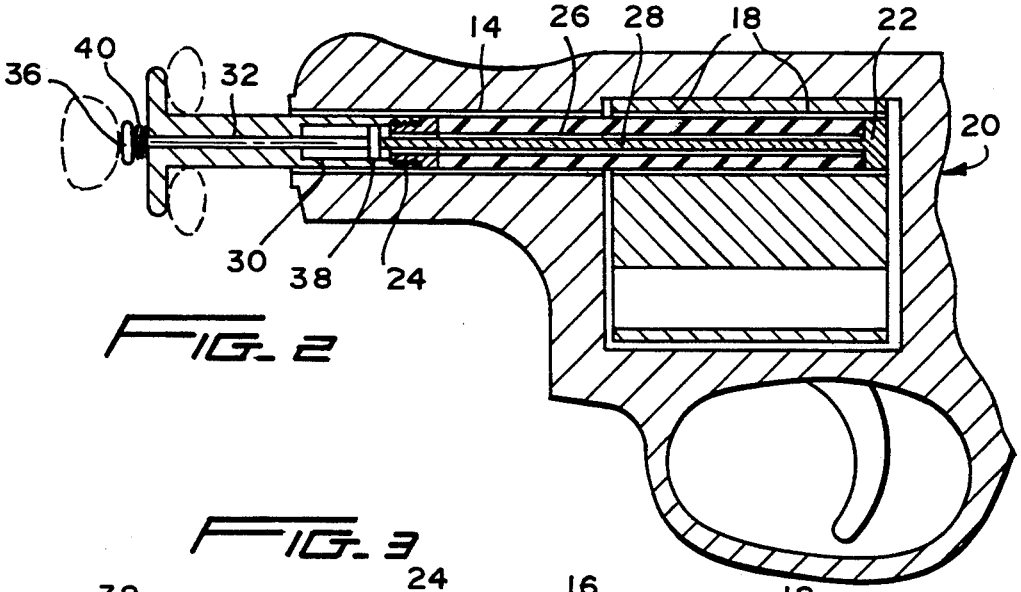
FIG. 2
FIG. 3
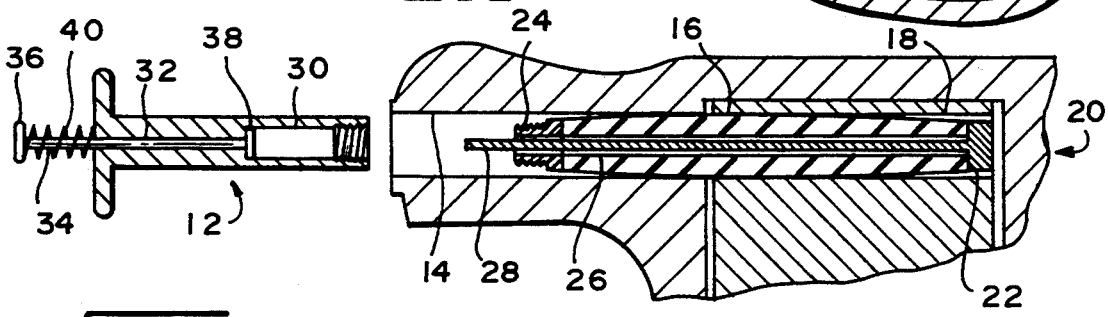
FIG. 4
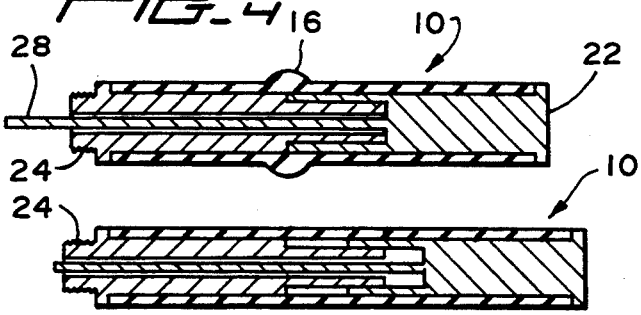
FIG. 5
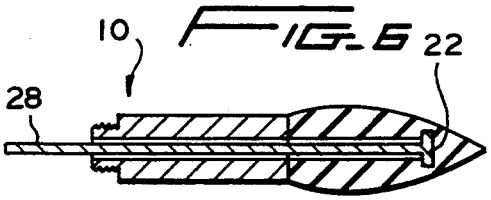
FIG. 6
FIG. 7
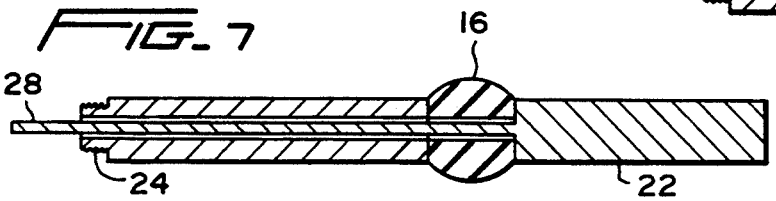

FIREARM SECURITY DEVICE

BACKGROUND OF THE INVENTION

The present invention concerns devices for temporarily disabling a firearm, as a safety measure, for example in the case of firearms owned by persons who have children in their homes.

In recent years heavy news media emphasis on violent crime has induced more and more citizens to retain firearms in the home for protection against criminal intruders, in addition to firearms owned for hunting. At the same time, there have been numerous reports of children having been injured or killed as a result of gaining access to firearms in the home.

Thus there is a need for firearm security devices which may be used to temporarily render a firearm inoperable, in a way which cannot be easily overcome by a child, and in a way which also allows the adult owner of the firearm to quickly and easily remove the disabling mechanism, should there be a sudden need to use the firearm against a criminal who is breaking into the home.

As detailed in the information disclosure documents filed with application for the present invention, various prior art firearm security devices have employed the general approach of providing a device to be inserted within the barrel and firing chamber of the firearm, using a removable member which is also used to extract the disarming device when the weapon is to be again rendered operable. However, a number of the prior art devices are considerably more complex in structure than the present invention, described below.

And applicant's device, although using the same general approach as just outlined, uses a simple specific approach not employed in any of the prior art devices known to applicant: provision of a device having a stretchable anchor member with portions which are normally slightly oversized in relation to the barrel and firing chamber of the firearm, and means to apply stretching force to stretch the anchor longitudinally so that the oversized portions may be inserted within the barrel and chamber, whereafter the stretching force is removed so that the anchor attempts to return to its oversized dimension, and thus becomes tightly wedged in the barrel and chamber, to disable the firearm.

The purpose of the invention is the provision of a simple, inexpensive and easily operated device to allow the temporary disabling of a firearm; to do so in a manner which cannot be overcome by a child; and to allow rapid rearming of the firearm by the adult owner when the weapon is needed.

SUMMARY OF THE INVENTION

The invention is a device to temporarily disable a firearm, having two main elements, an anchor and an extractor, both cylindrical in form. The extractor is sized to fit within the barrel of the gun, but a portion of the anchor is slightly oversized in its normal state, so as not to fit the barrel or chamber of the firearm. The anchor is formed of a rubber-like elastic material, resistant to oil, and, when sufficiently stretched longitudinally will decrease its radius slightly, sufficiently so that it can be inserted within the gun barrel and chamber. The anchor is to be inserted first into the gun barrel, with the extractor second, attached to the anchor, as described below. The end of the anchor which enters the barrel first has a cap, bonded to the anchor. The anchor has a longitudinal bore extending therethrough, which houses a loose fitting anchor shaft, with the anchor shaft being securely attached to the cap at one end, and with the other end of the anchor shaft extending somewhat beyond the other end of the anchor. Bonded to the end of the anchor opposite the cap, is a threaded fitting, of a diameter smaller than the gun barrel bore, through which the longitudinal bore and anchor shaft pass. The extractor has, on the end to be attached to the anchor, a recessed cylindrical cavity having threads matching the threaded fitting of the anchor. The extractor also has a longitudinal bore therethrough, housing an actuating rod, which extends somewhat beyond the outer end of the extractor (the end opposite the threaded recess for attachment to the anchor). The actuating rod has end portions larger than the longitudinal bore in the extractor, so that it cannot be separated from the extractor, and has a spring on the outer end, which normally holds the actuating rod in a position away from the anchor shaft. To insert the device into the gun in order to disable the firearm, the user first threads the extractor to the anchor; then depresses the actuating rod with the thumb, holding the extractor with other fingers, so as to move the actuating rod against the anchor shaft which passes through the anchor and is secured to the cap at the other end of the anchor, and thereby move the cap of the anchor away from the extractor, while the other end of the anchor is secured to the extractor by the threaded connection of the two, so as to stretch the anchor sufficiently to allow the anchor to be inserted within the gun barrel; then inserts the entire device into the gun barrel, sufficiently that the anchor extends into the chamber of the gun; then releases the thumb pressure on the actuating rod, thus ending the stretching of the anchor so that the anchor seeks to expand laterally to its oversized diameter and thus becomes tightly wedged within the barrel and chamber, so as to disable the gun; then unscrews the extractor from the anchor and removes the extractor, leaving the anchor in the cylinder so that the gun is inoperable. The device may be removed by carrying out the above-described procedure in reverse, when it is desired to put the firearm in an operable condition.

BRIEF DESCRIPTION OF THE DRAWINGS

FIG. 1 is a perspective view of the device.

FIG. 2 is a sectional view of the device within a revolver, with the extractor attached to the anchor, and with the actuating rod depressed to longitudinally stretch the anchor.

FIG. 3 is a sectional view of the anchor remaining within a revolver, partially within the barrel and partially within the chamber, also showing the extractor having been removed.

FIG. 4 is a sectional view showing one possible form of the anchor, in the longitudinally unstretched configuration.

FIG. 5 is a sectional view of the anchor of the form shown in FIG. 4, having been stretched longitudinally sufficiently to be insertable within a firearm.

FIG. 6 is a sectional view showing a different form of anchor.

FIG. 7 is a sectional view of yet another possible form of anchor.

DESCRIPTION OF THE PREFERRED EMBODIMENT

Figure 8:
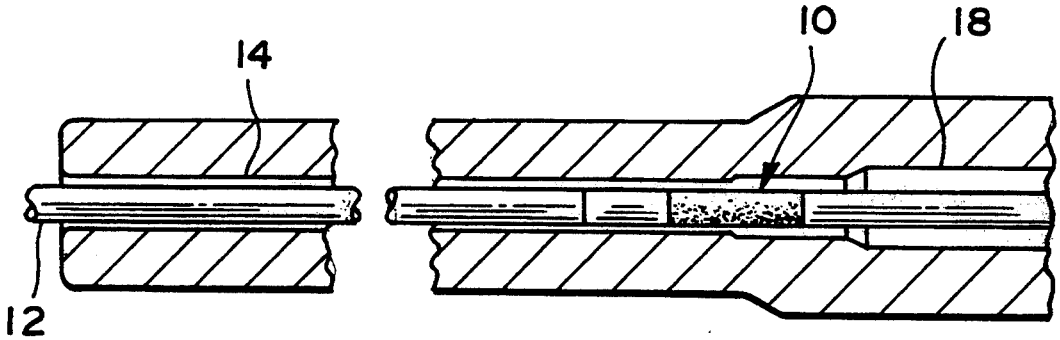
FIG. 8 is a sectional view showing one form of the anchor held by the extractor within a rifle barrel, with the anchor partially within the barrel and partially within the chamber, with the anchor in the longitudinally stretched position.

Referring now to the drawings, in which like reference numbers denote like or corresponding elements, the principal components of the present invention, in the preferred embodiment, are an anchor 10, and an extractor 12, both cylindrical in form and circular in cross section. The extractor 12 has a diameter less than the diameter of the bore of the gun barrel 14, so that it may be inserted within the barrel 14. The anchor 10 has an oversized portion 16, which is slightly too large to fit within the barrel 14 or the chamber 18 of the firearm 20. The body of anchor 10 is formed of a rubber-like elastic material, which is resistant to gun oil, so that anchor 10 may be stretched longitudinally, as described below, to reduce the diameter of oversized portion 16 of anchor 10 sufficiently to allow insertion of anchor 10 into the barrel 14 and chamber 18 of the firearm 20.

Figure 9:
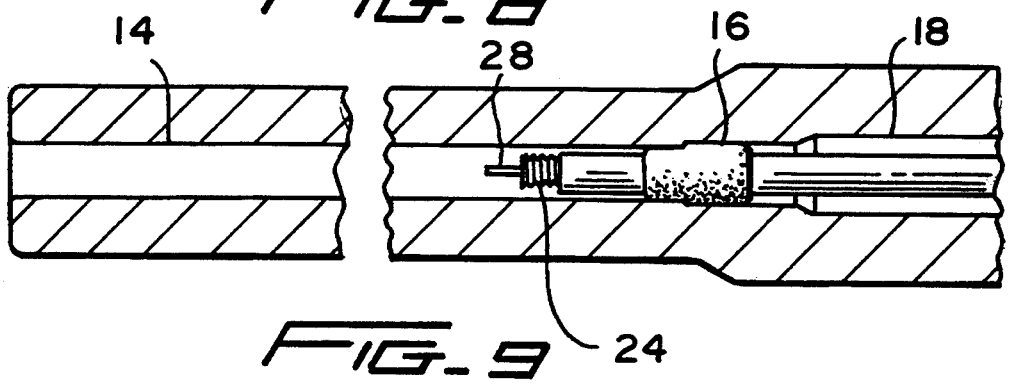
FIG. 9 is a sectional view as in FIG. 8, with the extractor removed, with the anchor in the longitudinally unstretched position, securing the anchor to the walls of the barrel and the chamber.
Figure 10:
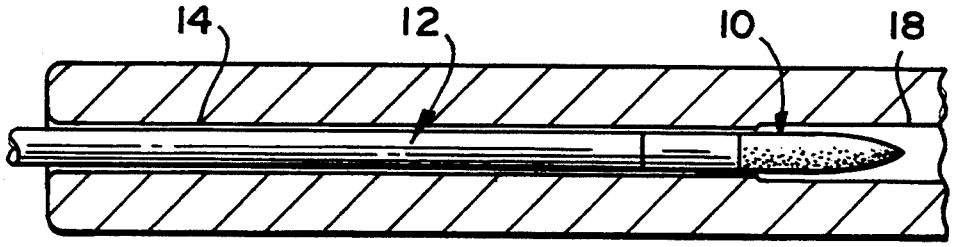
FIG. 10 is a sectional view of one form of the anchor held by the extractor within the barrel and chamber of an automatic pistol, with the anchor in the longitudinally stretched configuration.
Figure 11:
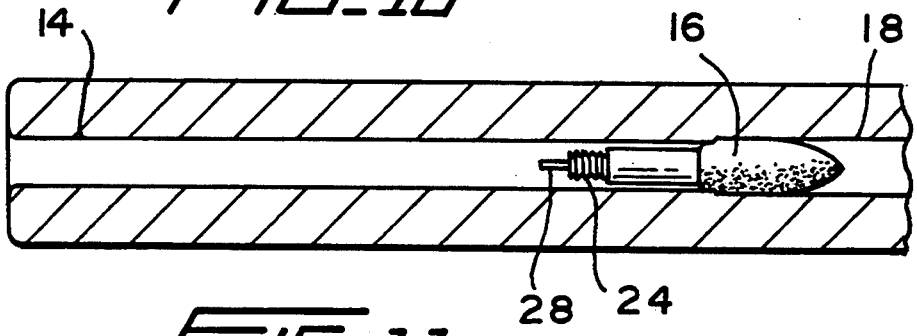
FIG. 11 is a sectional view as in FIG. 10, with the extractor removed, with the anchor in the longitudinally unstretched position, securing the anchor to the walls of the barrel and the chamber.

For the version of the device to be used with a revolver, the length of anchor 10 somewhat exceeds the length of the chamber 18, so that the anchor 10, when inserted, as indicated in FIG. 3, prevents operation of the weapon both because the cylinder cannot be rotated, and because a cartridge may not be loaded into the chamber. For an automatic pistol, in which the chamber joins the bore, the anchor 10 occupies a portion of chamber 18, and the operation of the weapon is prevented, when anchor 10 is installed, simply because the anchor 10 prevents loading a cartridge into the chamber 18, as indicated in FIGS. 10–11. For a rifle, in which a bottle shaped cartidge is used, the anchor 10 only expands in a portion of the chamber 18, to prevent loading a cartidge into the chamber 18, as indicated in FIG. 9.

A metal cap 22 is securely bonded to the end of anchor 10 which first enters barrel 14 of firearm 20. A threaded fitting 24, having a diameter smaller than that of anchor 10, is securely bonded to the end of anchor 10 opposite to the end bearing cap 22. A longitudinal anchor bore 26 extends through the entire length of anchor 10 up to cap 22, and through fitting 24. A loose fitting metal anchor shaft 28 is housed within anchor bore 26 and is securely attached at one end to cap 22, by threads or other secure attachment means. The anchor shaft 28 has a length exceeding the combined lengths of anchor 10 and fitting 24, so that it extends outward beyond the end of fitting 24, for a reason to be described.

The extractor 12 has at one end a recessed threaded portion 30, about ¾41 deep in the preferred embodiment, having threads matching those of fitting 24 on end of anchor 10. The extractor 12 is made of a soft metal, so as not to scratch the inside of barrel 14 of firearm 20. The extractor 12 has a longitudinal bore 32, extending from recessed threaded portion 30 of extractor 12, through the entire remaining length of extractor 12. A metal actuating rod 34 extends through and beyond the ends of bore 32, and has enlarged end pieces 36 and 38, larger in diameter than bore 32, so that actuating rod 34 cannot be removed from extractor 12, to prevent loss of actuating rod 34. The end pieces 36 and 38 may be secured to actuating rod 34 in any convenient manner, e.g. by matching threads or welding. A spring 40, located between end piece 36 and the body of extractor 12, holds the actuating rod 34 normally in a fully retracted position, as shown in FIG. 3, so that end piece 38 rests against the inner end of recessed threaded portion 30 of extractor 12, as also shown in FIG. 3.

In order to insert the anchor 10 within a firearm to disarm the weapon, the following simple operating procedure may be followed. The extractor 12 is first attached to anchor 10, by screwing the threads of recessed threaded portion 30, of extractor 12, onto the matching threads of fitting 24, of anchor 10. Next, the operator holds the extractor 12 between the index and middle fingers of one hand, and depresses the actuating rod 34 with the thumb, of the same hand. Depression of actuating rod 34 causes the other end of actuating rod 34, via end piece 38, to press against anchor shaft 28, and thus exert a force against cap 22. This force acts to stretch the elastic material of anchor 10 longitudinally, since the other end of anchor 10 is held in place, because fitting 24 is at the time secured to recessed threaded portion 30, of extractor 12. The operator applies sufficient stretching force, to stretch anchor 10 longitudinally sufficiently so that the slightly oversized portion of anchor 10 is reduced in radius sufficiently so that anchor 10 can be inserted within barrel 14 and chamber 18 of firearm 20. Holding the extractor 12 on actuating rod 34 as just indicated, to maintain the indicated stretching force, the operator then inserts the entire device into barrel 14, to a depth sufficient to allow anchor 10 to fill the entire length of chamber 18, and also a portion of the barrel 14 for the version of the invention used with a revolver, as indicated in FIG. 2. That depth of insertion may easily be indicated, for any given firearm, by a mark placed on the side of extractor 12, which mark may be placed thereon during manufacture. Once the device has been thus inserted, the operator releases the thumb pressure on actuating rod 34, and unscrews and removes extractor 12 from anchor 10. When the stretching force is thus removed from anchor 10, anchor 10 contracts longitudinally, and attempts to return to its normal radius. Thus anchor 10 becomes tightly wedged within chamber 18 and barrel 14, since anchor 10 is somewhat longer than the length of chamber 18, although being less than the combined length of chamber 18 and barrel 14, rendering the firearm inoperable. In the case of a revolver, the presence of the anchor 10 within chamber 18 and a portion of barrel 14, means that the cylinder may not be rotated, and a bullet may not be loaded into chamber 18. This configuration is shown in FIG. 3.

When it is desired to rearm the firearm, this may be done by carrying out the reverse of the steps described in the previous paragraph: i.e. inserting the extractor 12 into barrel 14, screwing extractor 12 onto anchor 10, holding extractor 12 between the two fingers and using the thumb to depress actuating rod 34, to apply stretching force to anchor 10, to stretch anchor 10 sufficiently to reduce its diameter sufficiently to allow it to become unwedged, and then removing the entire device from barrel 14 and chamber 18 while keeping the actuating rod 34 depressed to maintain the stretching force until the device is removed from firearm 20.

Various alternate possible forms of the anchor 10, in regard to the geometry of the portion of anchor 10 which is slightly oversized in relation to the diameter of the barrel 14 and chamber 18, are shown in FIGS. 4–7.

Those familiar with the art will appreciate that the invention may be employed in configurations other than the specific forms disclosed herein, without departing from the essential substance thereof.

For example, and not by way of limitation, the form of the anchor 10 may be varied as to which portion thereof is slightly oversized in relation to the diameter of barrel 14 and/or chamber 18. It is only necessary that some portion of anchor 10 be oversized in relation to either the diameter of barrel 14 or chamber 18, assuming that anchor 10 is longer than chamber 18, to achieve the wedging effect described above, so that anchor 10 will be locked within and disable firearm 20.

Similarly, although the anchor 10 and extractor 12 are cylindrical in form and of circular cross section, in the preferred embodiment, that specific geometry is not necessary. They could be of square cross section for example, provided that, in the case of anchor 10, the diagonal of the square was slightly larger than the diameters of barrel 14 and chamber 18, for at least a portion of the length of anchor 10.

The scope of the invention is defined by the following claims, including also all subject matter encompassed by the doctrine of equivalents as applicable to the claims.

I claim:

1. A firearm security device, for temporarily disarming and again rearming a firearm, said firearm having a barrel with an interior bore diameter and having a chamber with an inner diameter, said chamber communicating with said barrel, said chamber being for receipt and firing of ammunition cartridges, said firearm security device comprising:

(a) an anchor, fabricated of an elastic material, having a length at least substantially as long as said chamber of said firearm, and having an oversized portion of said anchor with a diameter slightly exceeding said inner diameter of said chamber and slightly exceeding said interior bore diameter of said barrel;

(b) insertion and extraction means, attachable to and removable from said anchor, for inserting said anchor into said barrel and said chamber, and for extracting and removing said anchor from said barrel and chamber; and (c) stretching means, attachable to said anchor, for applying a stretching force to said anchor sufficient for stretching said oversized portion of said anchor sufficiently that said anchor may be inserted within said barrel and said chamber of said firearm.

2. The firearm security device of claim 1, wherein said anchor has a length exceeding the length of said chamber, but less than the combined length of said chamber and said barrel.

3. The firearm security device of claim 1, wherein said anchor is at least substantially cylindrical in form.

4. The firearm security device of claim 1, wherein said anchor is formed of rubber.

5. The firearm security device of claim 1, wherein said insertion and extraction means comprises a cylindrical extractor, having a diameter less than the diameter of said interior bore of said barrel, and a recessed threaded portion of said extractor on one end of said extractor, and a threaded fitting on one end of said anchor, having threads matching said recessed threaded portion of said extractor.

6. The firearm security device of claim 5, wherein said stretching means comprises, in combination, each of: said insertion and extraction means in combination with a metal cap, bonded to the end of said anchor opposite said end bearing said threaded fitting; and a longitudinal bore passing through said anchor from said cap to the opposite end of said anchor; and a longitudinal bore passing completely through the length of said extractor; and an anchor shaft, loosely housed within said longitudinal bore of said anchor and having a length exceeding the length of said anchor; and an actuating rod, housed within said longitudinal bore in said extractor, and having a length, in combination with the length of said anchor shaft, such that when said actuating rod is fully depressed against said anchor shaft, with said extractor connected to said anchor, said anchor is stretched sufficiently to reduce the diameter of said oversized portion of said anchor sufficiently that said anchor may be inserted within said interior bore of said barrel and within said inner diameter of said chamber.

7. The firearm security device of claim 6, wherein said ends of said actuating rod are of larger diameter than the diameter of said longitudinal bore in said extractor.

8. The firearm security device of claim 7, further comprising spring means, connected to said actuating rod and said extractor, for causing said actuating rod to normally assume a position fully retracted away from, and not engaging, said anchor shaft.

9. The firearm security device of claim 1, wherein said oversized portion of said anchor has a length less than half of the total length of said anchor.

10. The firearm security device of claim 1, wherein said oversized portion of said anchor has a length greater than half of the total length of said anchor.

* * * * *